United States Patent [19]

Randell

[11] 3,998,059

[45] Dec. 21, 1976

[54] POWER SYSTEMS

[75] Inventor: John Edward Randell, Wirral, England

[73] Assignee: National Research Development Corporation, London, England

[22] Filed: July 9, 1974

[21] Appl. No.: 486,915

[30] Foreign Application Priority Data

July 12, 1973 United Kingdom ..... 33503/73

[52] U.S. Cl. ..... 60/659; 60/653; 60/671

[51] Int. Cl.[2] ..... F01K 25/10

[58] Field of Search ..... 60/651, 671, 650, 682, 60/684, 647, 659, 653

[56] References Cited

UNITED STATES PATENTS

| | | | |
|---|---|---|---|
| 2,421,387 | 6/1947 | Lysholm | 60/650 |
| 2,471,476 | 5/1949 | Benning et al. | 60/651 X |
| 2,471,755 | 5/1949 | Karrer | 60/655 |
| 2,933,885 | 4/1960 | Benedek et al. | 60/659 |
| 3,080,706 | 3/1963 | Flynn, Jr. | 60/523 |
| 3,324,652 | 6/1967 | Mailet | 60/647 X |

FOREIGN PATENTS OR APPLICATIONS

| | | | |
|---|---|---|---|
| 27,153 | 12/1898 | United Kingdom | 60/671 |
| 870,636 | | United Kingdom | 60/671 |

*Primary Examiner*—Allen M. Ostrager
*Attorney, Agent, or Firm*—Cushman, Darby & Cushman

[57] ABSTRACT

A transportable power system, suitable, for example, for powering a vehicle or a transportable machine tool, comprises a storage container for receiving and storing, in liquid form, a working fluid which is nevertheless gaseous at standard temperature and pressure and of non-toxic and/or non-inflammable nature, and self-contained heat supply means together with pump means by which the liquid working fluid is pumped through heat exchange means to convert it to its gaseous form and thence through the heat supply means, which is conveniently a thermal storage unit, wherein the temperature of the gas is raised preparatory to being expanded through means for converting the heat energy of the working fluid into mechanical work. The heat supply means should have a thermal capability sufficient to cause the temperature of the gas to rise to at least 200° C above its critical temperature. Preferably the heat supply means is a thermal storage heater in which the heat storage means comprises one or more chemical salts having high latent heat of fusion.

7 Claims, 6 Drawing Figures

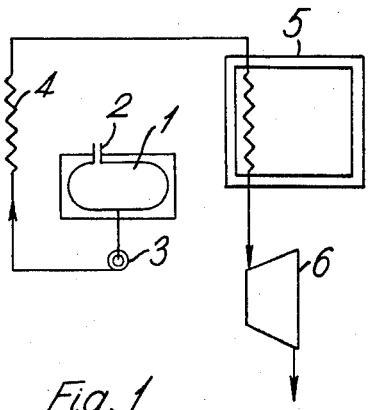
Fig. 1
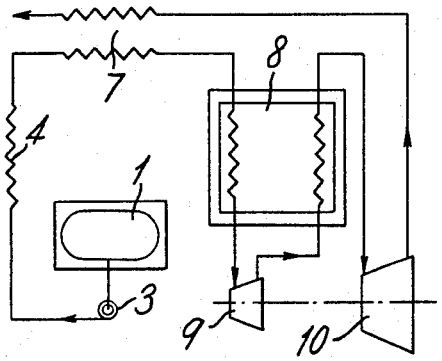
Fig. 2
Fig. 3
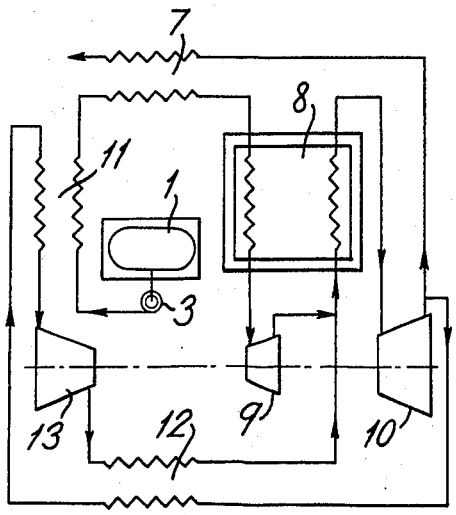

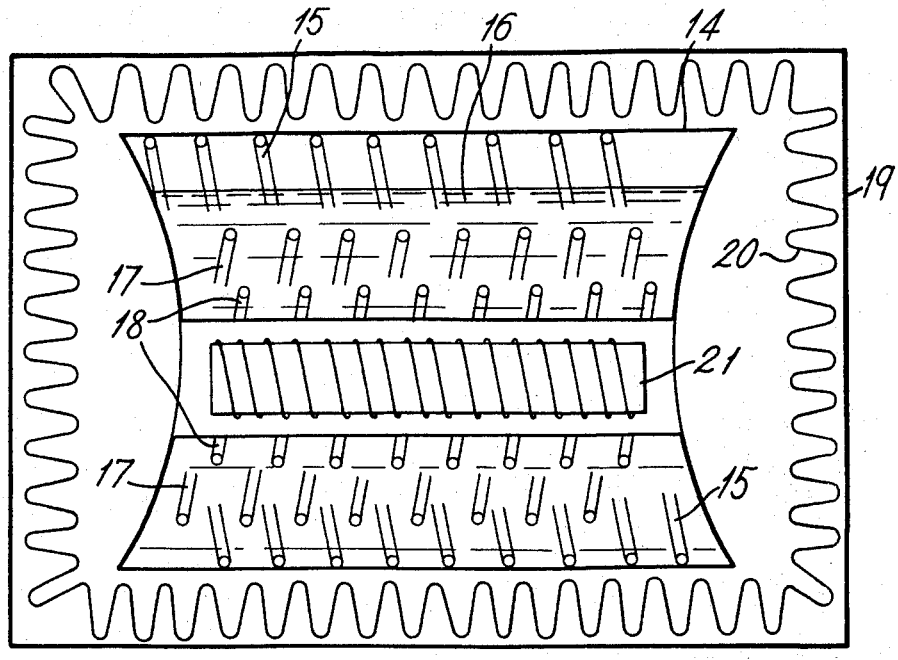
Fig. 4
Fig. 5
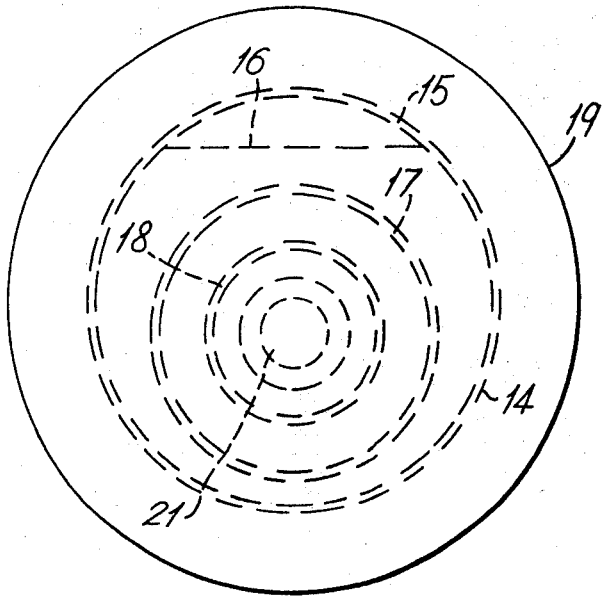

POWER SYSTEMS

This invention relates to power systems and more especially to transportable power systems, such as, for example, for powering a machine tool or a vehicle.

The invention has particular application to the provision of mechanical power for driving automotive vehicles since one of its objectives is to enable power to be generated in a transportation device or system without simultaneous evolution of noxious gases or the necessity to rely on live electrical circuits in the development of power.

Thus known power sources are petrol or diesel-fuelled or are electrical in nature; some power sources using petrol or diesel oil involve electrical power transmitting units. The use of petrol or diesel oil results in emission of noxious exhaust fumes which can be reduced adequately only at the expense of elaborate precautions; moreover, the fuel itself can constitute a fire risk. In addition, where a self-contained electrical power source has been used for traction purposes, especially for road vehicles, the source, almost invariably has required batteries and, almost exclusively, lead-acid batteries which, having a high weight-to-power ratio, must cause the traction device either to have a limited range or alternatively to be excessively heavy. Moreover any electrical circuitry, especially involving switching operations, although of no consequence as far as normal atmospheres are concerned, can create hazards if used in an environment, as in coal mines, which may contain explosive gases and/or vapours or mixtures of gases and vapours. Here, too, elaborate precautions, which lead to elaboration and complication, are necessary to minimise the hazard.

Proposals have already been made for the use of gas expansion engines operating with gas, such as liquid air or liquid nitrogen, stored under cryogenic conditions, and such engines need not present any of the problems set out above; the present invention represents an improvement in this art.

According to the invention there is provided a power system which comprises a heat-insulated storage container capable of receiving and storing, in liquid form, a working fluid which is gaseous at standard temperature and pressure and of non-toxic and/or of non-inflammable nature, self-contained means of providing heat, such as heat storage means or chemically reacting means, pump means adapted to transfer liquid working fluid from the storage container to said heat providing means, either directly or through one or more heat exchangers, said heat providing means having a thermal capability sufficient to raise the temperature of the pumped quantities of working fluid at least 200° C above its critical temperature (−147° C for nitrogen), and means for converting heat energy of the quantities of the thus heated gas into mechanical work.

Preferably the heat providing means has a thermal capability sufficient to raise the temperature of the pumped quantities of the working fluid to at least 830° C above the critical temperature of the gas.

In the case that the heat providing means is in the form of heat storage means, the heat storage means may be formed from solid material such as metal, graphite, refractory material or solidified chemical salts; alternatively, the heat storage means may comprise tubes or rods formed of one of the said materials. In the case of tubes which can conveniently be of alumina, these will probably be used for ducting the working fluid. Preferably, however, the heat storage means consists of or includes one or more fusible chemical salts or mixtures, such as eutectic mixtures, of chemical salts since these latter can have both a convenient melting point and also a high value of latent heat, making them particularly suitable.

The heat energy conversion means may comprise a single - or multi-stage expansion device such as a turbine or a piston -and- cylinder arrangement or any suitable combination of these. If a multi-stage expansion device is used, it is preferable that a heat-exchanger be provided intermediate any two stages.

Advantageously, the liquid working fluid is initially vaporised by heat exchange with the ambient atmosphere. Alternatively, heat for converting the liquid working fluid to its gaseous form may be derived from heat exchange with a gas stream exhausting from a said or other heat energy conversion means or from a conventional heat engine; preferably said exhaust gas stream is subsequently compressed and heated in said or other heat providing means and the heated gas is expanded to produce energy in said or other heat energy conversion means or said conventional heat engine.

In order that the invention may be more clearly understood, particular embodiments thereof incorporating heat storage means, will now be described, by way of example, with reference to the accompanying diagrammatic drawings, of which:

FIG. 1 shows a simple expansion system;

FIG. 2 shows a simple expansion system with reheating;

FIG. 3 shows a compound expansion system;

FIG. 4 shows, schematically, a section through a preferred thermal storage device for use in systems according to the invention in which vaporised working fluid is to be heated to a high temperature;

FIG. 5 illustrates an end view of the thermal storage device shown in FIG. 4.

Figure 6:
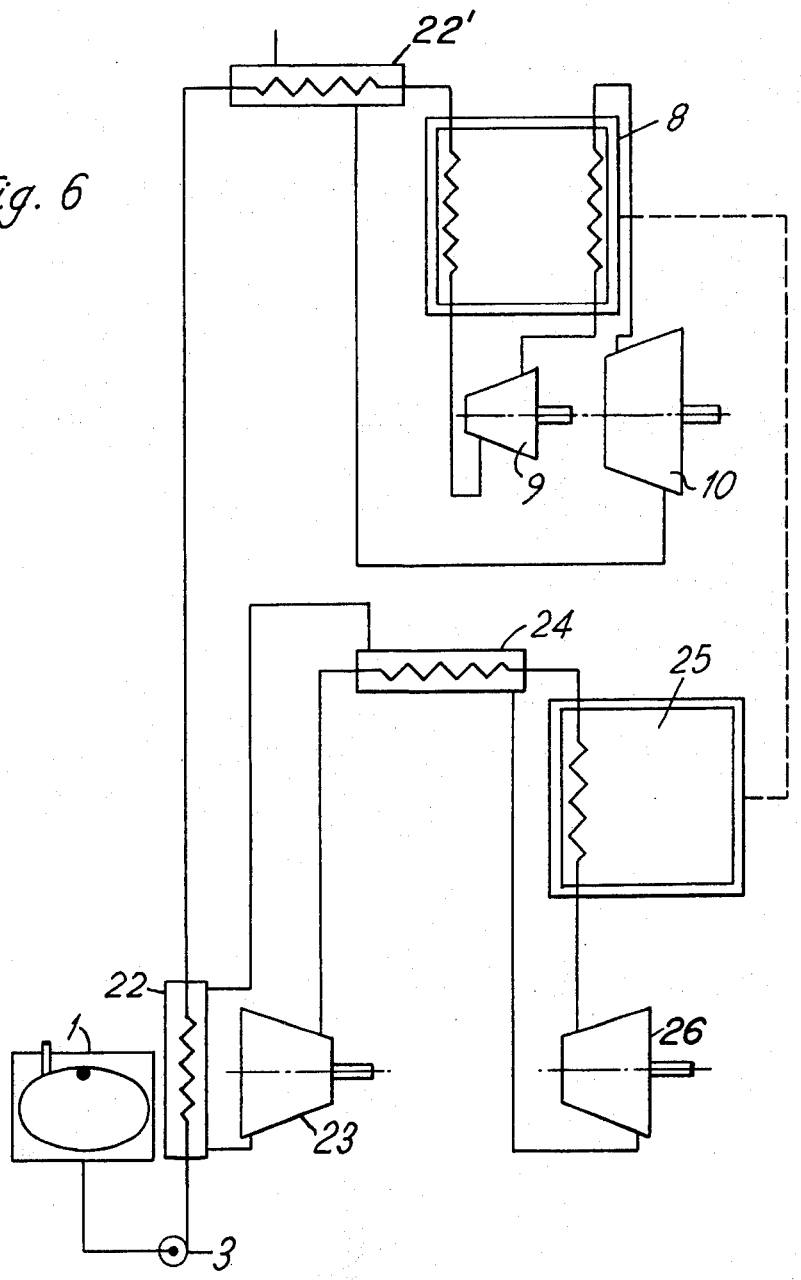
FIG. 6 is a diagrammatic representation of a system similar to that shown in FIG. 2 but including a conventional heat engine using the system of FIG. 2 as a heat sink.

In FIG. 1 a container 1 is provided for storage of liquid nitrogen (or liquid air) which is the working fluid for the particular embodiment of the invention. The container will usually be open to the ambient atmosphere but the working fluid could be subjected to a pressure in excess of atmospheric pressure though probably not more than about two atmospheres. The container itself is thermally insulated by the provision of a vacuum jacket (not shown) therearound. The container may be divided into compartments or, alternatively, it may contain a porous holding medium for the working fluid. In this arrangement shown in FIG. 1, the container 1 has a vent 2 which is open to atmosphere; this vent prevents a pressure build-up within the container. If, however, the contents of the container are pressurized, a pressure relief device may be provided to prevent any such pressure build-up.

A feed pump 3 withdraws liquid nitrogen (or liquid air) from the container and transfers the liquid to an evaporator 4 in which the liquid is heated to its critical temperature and above this temperature. In view of the extremely low boiling point of liquid nitrogen (or liquid air) that is below minus 180° C and correspondingly low critical temperature (−147° C for nitrogen), it will be apparent that no external heat need be provided for the evaporator 4 since the heat necessary to evaporate the liquid may be extracted from the ambient atmosphere. In order to prevent undue chilling of the ambient atmosphere, atmospheric air may be caused to flow over the evaporator by means of a fan (not shown) or, where the power system is used to power an automotive vehicle, by motion of the vehicle itself.

After evaporation, the now gaseous working fluid, which will have become heated by reason of its change of state from liquid to gas, passes to a heat storage unit 5 where it is heated to an appropriate temperature depending upon the characteristics of the unit. Sufficient knowledge widely exists to enable a suitable heat storage device to be designed for the particular purpose and there is no necessity for details to be given herein of dimensions of any specific arrangement of heat storage unit. The most convenient means for heating the heat storage unit would be electrical and it can be seen that the possibility exists for the use of off-peak electricity overnight for use of the power system during the day.

The expanded hot gas leaving the heat storage then passes to a unit, such as a turbine 6 when the heat from the heat content of the gas is converted into rotational energy at the output of the turbine. The amount of energy will, of course, depend upon the characteristics of the turbine but, here again, there is sufficient general knowledge of the design of turbines to enable a satisfactory design to be made, for the particular purpose for which the power system is intended.

Again, the invention is not confirmed to the use of turbines and it is to be understood that any suitable gas driven device may be used. Thus, it is envisaged that a piston-and-cylinder arrangement may be preferred in certain circumstances. However, in this particular system, whatever the arrangement, the gas is exhausted to atmosphere from the engine.

In the system of FIG. 2, the basic principles of the system of FIG. 1 are retained but an auxiliary heat exchanger 7 is introduced, this being located intermediate the evaporator 4 and the heat storage unit 8. The auxiliary heat exchanger 7 is used to raise the temperature of the gas from the evaporator. Less heat is then required to raise the temperature of the gas in the heat storage unit than without the heat exchanger 7; again the temperature rise will be dependent upon the design of the additional heat exchanger and of the heat storage unit. In this system of FIG. 2, the heated gas leaving the heat storage unit is fed to a high pressure turbine 9 from which the gas passes through the heat storage unit 8 for reheat purposes and thence to a low pressure turbine 10 on the same output shaft as turbine 9. The gas exhausts from the turbine 10 to the auxiliary heat exchanger 7 and thence to atmosphere.

In the compound system illustrated in FIG. 3, the evaporating liquid is in heat exchange with exhaust gas from the low pressure turbine 10 in an exhaust gas heat exchanger 11, the latter exhaust gas being drawn into a compressor 13 which is driven from the common output shaft of turbines 9 and 10. This compressor delivers gas into the exhaust line from the high pressure turbine 9. It is also possible that the liquid feed pump 3 could be operated from this common output shaft.

In this compound system, the ducting between the exhaust gas heat exchanger 12, in which heat is transferred from the exhaust gas to the gas leaving the compressor 13, and the heat exchanger 11 may be omitted, especially if liquid air is being used as the working fluid, since then atmospheric air is drawn into the compressor — it may be that the intended use of the power system would permit air to be drawn into the system even if liquid nitrogen were the primary working fluid. The temperature of the atmospheric air is reduced considerably by the heat exchanger 11, prior to compression, and the output of the engine is increased accordingly, because the work absorbed in compression is reduced thereby; there would be a design problem in that case, however, in that the evaporator would tend to frost, a feature which is otherwise absent from this compound system.

Although solid systems for the heat storage units are well known or can be readily devised it is not perhaps so obvious how a heat storage unit using a high specific heat capacity fused salt can be devised and FIGS. 4 and 5 are included to illustrate the principles of design of such a storage unit for use in a system according to the invention.

Thus this unit comprises a cylindrical vessel 14 of suitable metal, such as steel, with inverted hemi-spherical ends and a helically formed tube 15 is arranged in good heat conducting contact with the internal (or alternatively the outside) surface of the cylindrical wall of the vessel, each end of the tube being brought, if necessary, outside the vessel in liquid tight manner to enable gas flow connections to be made to the other parts of the system. This tube may serve also to support the wall of the vessel.

A fusible salt, or salt mixture, is intended to fill the vessel to the surface indicated by the line 16 in FIGS. 4 and 5. Supported within the salt are two helically formed tubes 17, 18 which may serve as separate ducts for conducting the gas through the heat storage unit in another part of the flow circuit. The tubes 17, 18 may be in series or parallel. These tubes may also be used to support part of the wall of the unit and, if the wall or walls of the unit is/are of corrugated form, the tubes may be arranged within the troughs of the corrugations.

The vessel 14 is mounted within a protective outer jacket 19 which is well insulated by insulating material illustrated by the wavy line 20. Connections, not shown, to the tubes 15, 17 and 18 are arranged to pass through this outer insulated jacket, each end of the tubes 17 and 18 being brought if necessary through the wall of the vessel 14. Electrical heating means 21 enable heat to be introduced to the salt first to melt it and then to increase its temperature.

Suitable salts for such a heat storage purpose are numerous. The following are given by way of example. Thus, it is particularly advantageous to use alkali or alkaline earth metal halides, especially the fluorides. Common salt (NaCl) melts at 800° C and has a latent heat of fusion of about 60 Wh/lb. (6.69 Kcal/mol), while sodium fluoride melts at a higher temperature; lithium fluoride (melting point, 842° C) is also of use. Alternatively sodium metaborate (melting point, 966° C) may be employed as may lithium hydride (melting point, 680° C). Still further alternatively, an eutectic mixture, of fluorides, for example of sodium fluoride and magnesium fluoride (melting point, 830° C), of borates or of a mixture of borates and fluorides may be used.

It will be necessary, of course, if the temperature of the working fluid is to be raised to a relatively high temperature, such as over, say, 650° C, that the salt or salts used for storing heat is or are molten.

As has been stated above, the heat providing means may, if desired, be means for producing a reversible chemical reaction such as the calcium oxide - water system.

If it is desired to use a liquid, this may be an oil, in which case a relatively high temperature can be obtained. Oil is, however, not favoured unless adequate precautions are taken to prevent spillage and leakage under operating conditions. The molten chemical salt will quite rapidly solidify when cooling below the operating temperature; in the latter case, the heat storage medium does, therefore, not tend to create a hazard should accidental rupture of the jacket occur. Of course, it would only be hazardous if the power system were to be used on a vehicle although, even in that case, suitable precautions could be taken.

If the power source according to the invention is to be used for a vehicle system tracked or non-tracked, the road or track wheels may be arranged to drive a compressor to assist in braking the vehicle. Such compressor may be connected with an auxiliary storage container (not shown) in which compressed gas can be stored on occasion for use in giving added acceleration to the vehicle. The auxiliary storage container may be connected between the compressor 13 and the turbine 10 shown in FIG. 3 and the compressor 13 used to compress gas for storage during braking.

In the power system depicted in FIG. 6, a power system according to the invention is associated with a conventional heat engine system, the system of the invention providing a very low temperature heat sink for the heat engine. In this Figure the liquid nitrogen (or liquid air) is pumped to a heat exchanger 22 through which air is drawn by a compressor 23 which vaporises the liquid which passes as gas to the heat storage unit 8 through an auxiliary heat exchanger 22'. The compressor is connected with the heat exchanger 24, for heating air prior to its being taken up to high temperature in a heat storage unit 25 in readiness for expansion through the conventional heat engine 26, the exhaust from this engine being passed through the heat exchanger 24 and 22 to be recycled by the compressor 23.

Although engine 26 is depicted as a turbine, any suitable conventional heat engine is envisaged and the compressor may similarly be other than axial as shown. The compressor is driven by the engine 26 and the latter may be associated with the drives of the devices 9 and 10. Also the heat storage unit 25 may be part of the main heat storage unit 8, as indicated by the dotted line joining these two units. Air for the conventional engine may be atmospheric air or may be supplied from a compressed supply. In addition, by providing a separate ambient temperature heat exchanger and suitable changeover valves, the conventional heat engine may be arranged to operate independently of the heat exchanger 22 so that the two systems could then operate as separate systems, if desired.

Other refinements are the possibility of using the working fluid in an additional heat exchanger for cooling the interior of a vehicle. Similarly a vehicle can be heated by effecting heat exchange of incoming air with the exhaust gas(es).

In order to clarify the invention still further, characteristic and operational data for two transportable, vehicular, power sources are given below for a light car and similarly for a medium size of car both utilising molten salt heat storage means and liquid nitrogen.

| EXAMPLE | A | B | C | D |
|---|---|---|---|---|
| System: as per | FIG. 2 | FIG. 3 | FIG. 3 | FIG. 3 |
| Thermal storage salt | NaCl | NaCl | NaF | LiF |
| Type of car | Light | Light | Medium | Medium |
| Average shaft work, Wh/mile | 170 | 170 | 340 | 340 |
| Tank capacity: gallons | 18.5 | 12.5 | 30 | 50 |
| lb | 138 | 94 | 224 | 375 |
| Liquid used, excluding loss: without/with refill, lb | 131/269 | 89/182 | 213/437 | 356/731 |
| Heat used, excluding loss, kWh | 15/27 | 19/34 | 51/83 | 77/128 |
| Heat stored (10% loss), kWh | 30 | 38 | 92 | 142 |
| Maximum temperature of thermal store, ° C | 850 | 850 | 1025 | 900 |
| Weight of salt, lb | 245 | 317 | 400 | 453 |
| Volume of salt, $ft^3$ | 2.6 | 3.3 | 3.3 | 4.1 |
| Estimated weight of tank and thermal store, lb: | | | | |
| with tank full | 574 | 617 | 936 | 1242 |
| with tank empty | 436 | 523 | 712 | 867 |
| Shaft output, kWh | 13.6/23.8 | 13.6/23.7 | 36.5/57.3 | 54.5/87.8 |
| Output/unit weight, based on mean estimated weight of tank and thermal store, Wh/lb | 27/47 | 24/42 | 44/69 | 52/83 |
| Range of car, miles | 80/140 | 80/140 | 107/168 | 160/258 |

Columns A and B are representative figures for light cars and columns C and D for medium cars.

Comparing the Figures for columns A and B, the average energy requirement is taken to be 170 Wh/mile of shaft energy, the equivalent of an electric motor having efficiency of 85 per cent taking 200 Wh/mile from batteries. It will be seen that for the same range, i.e. 80 miles without liquid nitrogen refill and 140 miles with refill, the estimated overall weights do not differ greatly for the alternative systems. The estimated running costs in liquid nitrogen consumption and heat supply to the storage means is higher for system A, 1.30 to 1.52 pence/mile (taking the cost of nitrogen to be 0.75 p/lb. and the cost of electricity as 0.4 p/kWh.), then for system B, 0.94 to 1.08 pence/mile because of the difference in liquid nitrogen consumption. In the examples shown, the running cost in liquid nitrogen consumption rises after the liquid tank is refilled to extend the range. This is because initially mainly latent heat is used and the temperature of the thermal storage unit is maintained close to its maximum value; after refilling, only the sensible heat given out below the melting point of the salt is available and liquid consumption increases as the thermal store cools.

Referring now to columns C and D of the above table where the cars are of medium performance, the average energy requirement is higher than for the light cars because the weight is greater and the anticipated maximum speed is higher — it has been assumed to be 340 Wh/mile i.e. double that for the light cars. This is approximately the equivalent of a petrol consumption of 30 miles per gallon for a standard equivalent petrol-driven car.

Example C using the compound system of FIG. 3 shows the peformance with sodium fluoride (NaF), a not expensive salt but with a higher melting point than the common salt (NaCl) used in the comparative systems of Examples A and B. Sodium fluoride melts at 995° C and has a latent heat of fusion of about 100 Wh/lb - 67 per cent greater than that for common salt. Using the same compound system, the figures for example D are for a thermal storage unit using lithium fluoride (LiF) which is a comparatively expensive material melting at 860° C and having a latent heat of fusion of 131 Wh/lb. Between temperature limits of 225° C and 900° C — a workable range for a liquid nitrogen system — the heat stored amounts to approximately 314 Wh/lb. If lithium fluoride were to be used in place of common salt in Example B, the weight of salt required would be reduced to 113 lb. and the estimated maximum weight of storage equipment reduced to 310 lb., a reduction of 50 per cent. The saving in volume of salt would be even greater, that is, a reduction to one-third (1 cubic foot), giving a very compact thermal store.

The use of lithium fluoride for Example D indicates that a higher mileage can be obtained than when using sodium fluoride in Example C — a range of 160 miles — extended to 258 miles by refilling with liquid nitrogen, as against 107 miles — extending to 168 miles with a refill. Moreover, the range up to 258 miles can be achieved with a maximum estimated storage equipment weight of 1242 lb. This weight reduces to 867 lb as the liquid nitrogen is emptied so that the mean weight is 1055 lb. With tank empty, the vehicle could be used for short journeys at reduced power using heat alone, the running cost being much lower in such use. The average running cost would then depend upon the relative mileage covered with and without the use of liquid nitrogen. It is conceivable that liquid nitrogen might be used only occasionally if long journeys were infrequent.

What I claim is:

1. A power system comprising a heat-insulated storage container for receiving and storing, in liquid form, a working fluid which is gaseous at standard temperature and pressure and of non-toxic, non-inflammable nature, self-contained means for supplying heat, without the addition of energy thereto, during supply of liquid working fluid thereto, pump means for transferring liquid working fluid from said fluid storage means to heat exchange means for converting said liquid to its gaseous form, said heat exchange means being in a flow circuit including said pump means and said heat supply means, said means for supplying heat having a thermal capacity sufficient to raise the temperature of the pumped quantities of working fluid to at least 200° C above its critical temperature, an expansion device having at least one stage for converting heat-energy of the thus heated gaseous working fluid into mechanical work, compression means for compressing gas exhausting from said heat-energy conversion means, and duct means for conducting compressed gas from said compression means to said heat supply means for reheating said compressed gas for expansion in said heat-energy conversion means.

2. A power system as claimed in claim 1, wherein said heat-energy conversion means comprises a heat engine and wherein said system further comprises additional heat exchange means for thermal exchange between exhaust air from said heat engine and said working fluid.

3. A power system as claimed in claim 1, comprising additional heat exchange means through which said exhaust gas is passed before entering said compression means, thereby to cool said gas before compression.

4. A power system as claimed in claim 3, wherein said exhaust gas heat exchanger is connected for heat exchange with said liquid working fluid to convert same to the gaseous condition.

5. a power system as claimed in claim 4, comprising a still further heat exchanger connected to heat exchanger between said exhaust gas and compressed gas from said compression means.

6. A power system as claimed in claim 1, wherein said compression means is powered by said heat energy conversion means.

7. A power system as claimed in claim 1, wherein said heat energy conversion means is the powering means for a transportable machine tool.

* * * * *